166-66 SR

11/25/86 OR 4,624,309

United States Patent [19]

Schnatzmeyer

[11] Patent Number: 4,624,309

[45] Date of Patent: Nov. 25, 1986

[54] APPARATUS FOR MONITORING A PARAMETER IN A WELL

[75] Inventor: Mark A. Schnatzmeyer, Lewisville, Tex.

[73] Assignee: Otis Engineering Corporation, Dallas, Tex.

[21] Appl. No.: 653,585

[22] Filed: Sep. 24, 1984

[51] Int. Cl.[4] ..... E21B 47/00; E21B 23/03

[52] U.S. Cl. ..... 166/66; 73/151; 339/94 R; 166/250

[58] Field of Search ..... 166/66, 250, 65.1, 117.5; 339/117 R, 94 R; 73/151; 174/47

[56] References Cited

U.S. PATENT DOCUMENTS 3,939,705 2/1976 Glotin et al. ..... 73/151

4,105,279 8/1978 Glotin et al. ..... 339/94 R X

*Primary Examiner*—Stephen J. Novosad

*Assistant Examiner*—Thuy M. Bui

*Attorney, Agent, or Firm*—Albert W. Carroll

[57] ABSTRACT

Apparatus including a side pocket mandrel for inclusion in a well tubing string for removably receiving an instrument in its offset receptacle bore for monitoring at least one parameter such as pressure, temperature or the like, at a downhole location, there being an electrical conductor (wire) extending from equipment at the surface downward to the side pocket mandrel and a plug in the lower end of the receptacle for electrically connecting the instrument in the receptacle with the conductor (wire) extending from the surface so that electrical energy may be transmitted downhole to power the instrument, that the instrument may generate electrical signals representing data sensed in the well and transmit them to the surface for processing and immediate display, printout, or storage.

10 Claims, 16 Drawing Figures

APPARATUS FOR MONITORING A PARAMETER IN A WELL

BACKGROUND OF THE INVENTION

1. Field of the Invention

This invention relates to well tools and more particularly to apparatus for monitoring one or more parameters (sucn as pressure, temperature, or the like) in a well.

2. Related Art and Information

It has been common practice for many years to record down-hole pressures, temperatures, and other parameters in wells through use of instruments lowered from the surface on wire line, electric cable, or similar means. The instruments were powered by clockworks, or by electrical energy either supplied by a battery carried in them or transmitted to them from the surface. Data gathered in this manner were recorded on a chart, stored in a memory bank after being processed by a microprocessor, or in cases where the instrument was powered by electricity transmitted to it from the surface, data sensed by the instrument were converted to electrical signals which were transmitted via the electrical cable to suitable equipment at the surface which processed the signals and displayed these data in real time and/or stored the resultant data for subsequent printout. It is known to install instruments in wells for recording or gathering data over a period of several hours or several days during which time other tools may be lowered into the well, the instrument being later retrieved with a retrieval tool. It is known to use a special side pocket mandrel in which to install instruments for such purposes. The side pocket mandrel is connectable in the well tubing string to form a part thereof, has a main bore therethrough aligned with the tubing bore, has a receptacle bore laterally offset from the main bore and extending alongside thereof, the receptacle bore having an upstanding electrical contact or prong in its lower end connected through an insulated plug to an insulated conductor (wire) extending from the plug to suitable equipment at the surface. The instrument in this case is lowered into the well on a wire line and kickover tool and installed in the receptacle bore after which the wire line and kickover tool are retrieved from the well. When the instrument is installed in the side pocket mandrel, an electrical socket in its lower end telescopes down over the upstanding electrical contact in the receptacle bore to establish electrical contact so that the instrument may receive electrical energy transmitted thereto from the surface and so that the instrument may send suitable electrical signals to the surface for processing, display, printout, and/or storage in a memory bank.

Examples of side pocket mandrels, downhole electrical connectors, kickover tools, and running tools are found in the prior patents listed below (one copy each of the most pertinent ones being enclosed with this application).

| Patents of The United States | | | | |
|---|---|---|---|---|
| Re.24,403 | 3,059,210 | 3,713,483 | 3,837,398 | 4,103,740 |
| Re.28,588 | 3,059,700 | 3,727,683 | 3,867,983 | 4,105,279 |
| Re.29,870 | 3,105,509 | 3,727,684 | 3,874,445 | 4,106,563 |
| Re.25,292 | 3,268,006 | 3,729,699 | 3,876,001 | 4,106,564 |
| 2,664,162 | 3,277,838 | 3,732,928 | 3,889,748 | 4,135,576 |
| 2,679,903 | 3,282,348 | 3,736,548 | 3,891,032 | 4,146,091 |
| 2,679,904 | 3,311,509 | 3,741,299 | 3,899,025 | 4,169,505 |
| 2,824,525 | 3,353,607 | 3,741,303 | 3,939,705 | 4,197,909 |

-continued

| | | | | |
|---|---|---|---|---|
| 2,828,698 | 3,353,608 | 3,752,231 | 3,958,633 | 4,201,265 |
| 2,914,078 | 3,378,811 | 3,753,206 | 3,965,979 | 4,224,986 |
| 2,923,357 | 3,398,392 | 3,788,397 | 3,994,339 | 4,239,082 |
| 2,942,671 | 3,439,626 | 3,796,259 | 4,002,203 | 4,271,902 |
| 2,948,341 | 3,491,326 | 3,799,259 | 4,030,543 | 4,294,313 |
| 2,962,097 | 3,561,528 | 3,802,503 | 4,031,954 | 4,325,431 |
| 2,964,110 | 3,581,818 | 3,807,428 | 4,033,409 | 4,333,527 |
| 2,994,335 | 3,603,393 | 3,807,498 | 4,034,806 | 4,368,780 |
| 3,014,533 | 3,610,336 | 3,807,499 | 4,035,011 | 4,375,237 |
| 3,022,829 | 3,627,042 | 3,827,489 | 4,039,026 | 4,416,330 |
| 3,040,814 | 3,641,479 | 3,827,490 | 4,051,895 | 4,440,222 |
| 3,054,456 | 3,666,012 | 3,828,853 | 4,066,128 | 4,442,893 |
| | | | | 4,452,305 |
| Patents of Canada | | | | |
| 991539 | 1001065 | | | |

U.S. Pat. Nos. Re. 29,870 which issued to Howard H. Moore, Jr., et al. on Dec. 26, 1978 and the original thereof, 3,827,490 which issued to Howard H. Moore, Jr., et al. on Aug. 6, 1974, diclose an orienting type side pocket mandrel which is considered typical. It has the usual main bore, an offset receptacle bore alongside thereof, a belly above the receptacle oore providing space for operation of a kickover tool, and an orienting sleeve above the belly for orienting a kickover tool with respect to the receptacle bore.

U.S. Pat. No. 3,827,490 which issued to Harold E. McGowen, Jr. on Aug. 6, 1974, discloses an orienting type side pocket mandrel which has an orienting sleeve below the receptacle for orienting a kickover tool and a trip shoulder above the belly for actuating such kickover tool.

U.S. Pat. No. 4,294,313 which issued to Harry E. Schwegman on Oct. 13, 1981, discloses an orienting type side pocket mandrel having much the same characteristics as the mandrel of U.S. Pat. No. 3,827,490 but having a 360-degree trip shoulder above the belly for actuating a pumpdown type kickover tool.

U.S. Pat. No. 4,333,527 which issued to Robert S. Higgins, et al. on June 8, 1982, discloses a side pocket mandrel of the orienting type constructed without longitudinal structural welds and made sturdy to withstand high differential pressures in either burst or collapse, the main body portion being formed essentially from a solid block of steel.

U.S. Pat. No. 4,416,330 which issued to David T. Merritt, et al. on Nov. 22, 1983, discloses a side pocket mandrel structured very much like that of U.S. Pat. No. 4,333,527, but wherein the upper body section of the mandrel has a main bore and a longitudinal keyway-like channel formed in the wall of the main bore, this channel being aligned with the receptacle bore and providing space thereabove for the operation of a kickover tool.

U.S. Pat. No. 4,440,222 which issued to William H. Pullin on Apr. 3, 1984, discloses orienting type side pocket mandrels having improved orienting sleeves.

U.S. Pat. No. 3,939,705 which issued to Bernard J. P. Glotin, et al. on Feb. 24, 1976, and U.S. Pat. No. 4,105,279 which issued to Bernard J. P. Glotin, et al. on Aug. 8, 1978, the latter patent being a division of the former patent, disclose side pocket mandrels of the non-orienting type each having a main bore, an offset receptacle bore, a belly above the receptacle bore providing space for operation of a kickover tool, and an upstanding electrical contract in the offset receptacle bore engageable by a mating electrical socket on a monitoring instrument installed in the receptacle bore, the electrical contact in the receptacle bore being connected via an electrical conductor extending to the surface. These patents disclose in detail the mating parts of the plug-in connector (that portion carried on the instrument and that portion carried on the side pocket mandrel).

Additional prior art plug-in connections for subsurface use are disclosed in U.S. Pat. Nos. 3,059,210; 3,378,811; 3,398,392; 3,491,326; 3,641,479; 3,729,699; 3,736,548; and 3,753,206.

U.S. Pat. No. 3,958,633 which issued to James A. Britch, et al. on May 25, 1976, discloses a side pocket mandrel having a lateral port in its offset receptacle bore connected to the lower end of a hydraulic control line extending from the surface.

U.S. Pat. No. 4,224,986, which issued to Robert H. Rothberg on September 30, 1980, discloses a side pocket device having a pair of hydraulic control lines connected to a pair of lateral ports in its offset receptacle bore.

U.S. Pat. No. 4,325,431, which issued to Neil H. Akkerman on Apr. 20, 1982, discloses a side pocket mandrel having a lateral port in its offset receptacle bore connected to a hydraulic control line.

U.S. Pat. No. 3,353,608, which issued to Fred F. Beebe on Nov. 2, 1967, discloses an early type kickover tool which is actuated in response to its trip key engaging a downwardly facing shoulder when the kickover tool lifted in the well tubing.

U.S. Pat. No. 4,294,313, which issued to Harry E. Schwegman on Oct. 13, 1981, discloses a kickover tool of the 90-degree type wherein its pivot arm pivots from an aligned position to a misaligned position wherein it extends outward of the kickover tool at substantially 90-degrees thus making possible much shorter side pocket mandrels and applying straighter axial forces to valves and the like as they are installed and removed thereby.

U.S. Pat. No. 3,837,398, which issued to John H. Yonker on Sept. 24, 1974 is an improvement over the Schwegman kickover tool (U.S. Pat. No. 4,294,313, supra) in which the pivot arm is releasably locked in its misaligned position until withdrawn from the side pocket mandrel.

U.S. Pat. No. 4,103,740, which issued to John H. Yonker on Aug. 1, 1978 is a further improvement over the kickover tool of Schwegman (U.S. Pat. No. 4,294,313, supra) in which the orienting key is designed for more dependable operation.

U.S. Pat. No. 3,876,001, which issued to William B. Goode on Apr. 8, 1975, discloses an orienting type kickover tool which when oriented and actuated hinges intermediate its ends and swings its lower portion toward to a position above the offset receptacle of a side pocket mandrel.

U.S. Pat. No. 4,051,895 which issued to Hugh D. Embree on Oct. 4, 1977, and U.S. Pat. No. 4,031,954 which issued to Gerald P. Hebert on June 28, 1977, both cover slight improvements over the kickover tool of Goode (U.S. Pat. No. 3,876,001, supra).

U.S. Pat. No. 4,368,780 which issued to David T. Merritt on Jan. 18, 1983, discloses a kickover tool which is an improvement over the kickover tool of Goode (U.S. Pat. No. 3,876,001, supra) the improvement enabling the kickover rool to be actuated by engaging a conventional orienting sleeve but without engaging the conventional tripping shoulder at the upper end of its orienting slot. A further improvement relates to a detent which helps to maintain the kickover tool in its misaligned position after it has been actuated to such position.

U.S. Pat. No. 4,442,893 which issued to Tommy C. Foust on Apr. 17, 1984, discloses an improved 90-degree type kickover tool which is very simply structured of minimal parts.

U.S. Pat. No. 2,962,097 which issued to William W. Dollison on Nov. 29, 1960, discloses (see FIG. 6) a tool having a collet for engaging a well tool and which is releasable upon shearing a pin. This type of tool can be used for certain running or pulling operations and can be arranged to shear the pin for release in response to upward or downward jarring impacts.

U.S. Pat. No. 4,035,011 which issued to Imre I. Gazda, et al. on July 12, 1977, discloses a running tool having a collet for engaging a well tool, the collet being spring biased to a position wherein the collet fingers are supported against inward movement to, thus, maintain engagement with the well tool, the collet being movable to releasing position upon application of sufficient pulling force to the running tool to overcome the spring load and move the collet to a position wherein the collet fingers are not supported and may move to releasing position.

The present invention is an improvement over the known prior art and overcomes many of the shortcomings associated therewith and is more suitable for use with modern, more sophisticated, accurate, and very costly and delicate instruments.

SUMMARY OF THE INVENTION

The present invention is directed toward apparatus for monitoring at least one parameter at a downhole location in a well, the apparatus including a side pocket mandrel having a main bore therethrough, a receptacle bore offset from the main bore and extending alongside thereof, and a longitudinal keyway-like channel in the wall of the main bore aligned with and extending upwardly from the upper end of the receptacle bore to provide space for operating a kickover tool and for protectively housing an instrument having its lower end portion telescopingly engaged in the receptacle bore, the receptacle being provided with an electrical feed-through member in the lower end of the receptacle bore having its internal end engageable by an electrical socket or contact on the lower end of an instrument and having its external end electrically connected via an electrical conductor (wire) to a source of electrical energy and suitable equipment at the earth's surface. The feed-through member which forms a part of the side pocket mandrel and the mating electrical socket mechanism attachable to a suitable instrument are improved items. The kickover tool of this invention includes a body having a flat side with connection means at its upper end and a pivot arm pivotally mounted near the lower end thereof, an actuator having a flat side and operatively slidably connected to the body with their flat sides facing each other, the actuator having connection at its lower end with the pivot arm so that longitudinal movement of the actuator relative to the body causes the pivot arm to pivot between aligned and extended positions, the actuator carrying an orienting key near its upper end for engaging the orienting sleeve in the side pocket mandrel to cause actuation of the kickover tool to move the pivot arm from aligned to extended position. The kickover tool is provided with a mechanism for positively locking the kickover tool in actuated position, this locking mechanism being releasable responsive to the kickover tool being withdrawn from the side pocket mandrel, this unlocking occurring just prior to the pivot arm being returned to its initial aligned position. The kickover tool is provided with a cam surface formed on its pivot arm and with a novel running tool attached to the outer end of the pivot arm, the running tool having a spring-biased operator rod having its upper end bearing against the cam surface on the pivot arm, the running tool having a body and a collet carried thereby, the collet having fingers with bosses thereon for engaging an instrument for supporting the same, the operator rod having an enlargement thereon for supporting the collet fingers against movement to releasing position when the pivot arm is in its aligned position, the operator rod being movable to releasing positon in response to the pivot arm being moved to extended positon so that the enlargement no longer supports the collet fingers, the collet fingers still, however, supporting the instrument, the collet being disengageable from the instrument upon the kickover tool being lifted after the instrument has been installed in the receptacle bore of the side pocket mandrel.

It is therefore one object of this invention to provide improved apparatus for monitoring at least one parameter at a downhole location in a well.

It is another object to provide an improved side pocket mandrel for connection into a well tubing, the mandrel having electrical means engageable with an instrument for electrically connecting the instrument to a power supply and other equipment at the surface.

Another object to this invention to provide such a side pocket mandrel having sufficient space above its receptacle bore to accommodate the longest instrument currently anticipated to be used for monitoring parameters at downhole locations in wells.

A further object is to provide a side pocket mandrel of the character described having improved electrical connection means.

Another object is to provide an improved kickover tool having means for positively locking the same in its actuated or misaligned position.

Another object is to provide such a kickover tool in which the positive lock means is released automatically in response to the kickover tool being withdrawn from the side pocket mandrel.

A further object is to provide such a kickover tool having improved detent means which tends to maintain the tool in either aligned and misaligned positions.

Another object of this invention is to provide such a kickover tool having improved orienting key means.

Another object is to provide such a kickover tool having means for catching an instrument carried thereby should such instrument become disengaged from the kickover tool at the improper time in the well.

Another object is to provide such a kickover tool having a pivot arm formed with a cam surface to be engaged by an operator rod a running tool for unlocking the collet of the running tool upon the pivot arm being pivoted from aligned to misaligned position.

Another object of this invention is to provide a running tool for use with a kickover tool of the character just described, the running tool having a tubular body with a plurality of dependent collet fingers each having a boss thereon, these bosses being engageable with a well tool such as the instrument mentioned earlier, said running tool having an operator rod disposed therein for longitudinal movement, this rod having an enlargement thereon which in one positon of the rod is disposed in position to support the collet fingers against movement to releasing position and in the other position of the rod the enlargement being in a location where it cannot interfere with the movement of the fingers to releasing positon, this operator rod being spring biased to a position holding the collet fingers engaged, the upper end of the operator rod protruding from the upper end of the running tool body being engageable with a cam surface formed on the pivot arm of a kickover tool.

Other objects and advantages will become apparent from reading the description which follows and from studying the accompanying drawing wherein:

DESCRIPTION OF THE PREFERRED EMBODIMENTS

Figure 1:
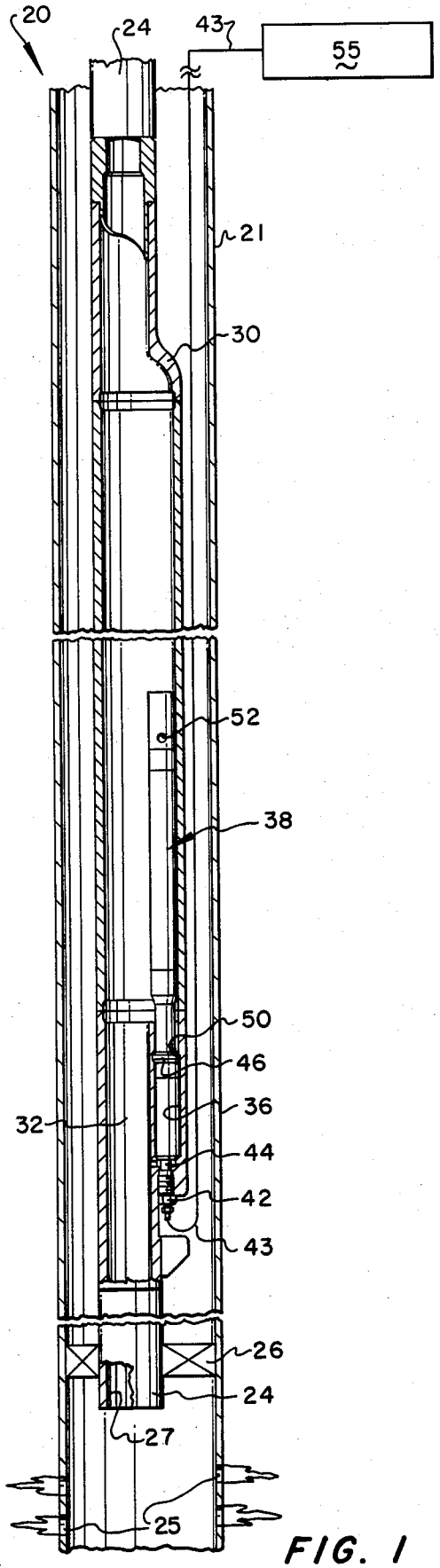
FIG. 1 is a schematical view showing a subsurface portion of a well having means installed therein for monitoring a parameter, pressure or temperature, or the like, and for transmitting appropriate signals to the surface for processing.

Referring now to FIG. 1, it will be seen that the well 20 is provided with well casing 21 in which is installed a well tubing 24. A packer 26 seals the annulus between the tubing 24 and casing 21 in the lower part of the well 20. The annulus may be filled as desired with gas, liquid, mud, or the like. Production fluids from the formation (not shown) enter the casing 21 through perforations 25 below the packer 26 and flow upwardly through the bore 27 of well tubing 24 to the surface.

For monitoring a parameter, such as pressure, and/or temperature, or the like, at a downhole location in the well while receiving values of such parameter or parameters at the surface virtually instantaneously, the well 20 is further provided with equipment which will now be described.

A special form of side pocket mandrel 30 is connected into the well tubing 24 at the desired location to become a part thereof. Thus, production fluids will flow upwardly through the side pocket mandrel on their way to the surface.

Side pocket mandrel 30 is similar to those side pocket mandrels disclosed in U.S. Pat. Nos. Re. 29,870 to H. H. Moore, et al., 4,333,527 to Robert S. Higgins, et al., 4,416,330 to David T. Merritt, et al., as well as 3,939,075 to Bernard J. P. Glotin, et al., and 4,105,279 also to Bernard J. P. Glotin, et al., all of which patents are incorporated into this application for all purposes by reference thereto.

The side pocket mandrel 30 has, of course, a main bore 32 extending through it from one end to the other and this main bore is axially aligned with the bore 27 of the tubing. The side pocket mandrel is further provided with a laterally offset receptacle bore 36 for receiving an instrument 38 suitable for monitoring the desired parameter or parameters. Above the offset receptacle bore 36, the side pocket mandrel is shown to have a belly providing ample space for operation of a suitable kickover tool, to be described later, for installing tools such as instrument 38 in or removing such instruments from the receptacle bore.

Similarly to the manner taught in U.S. Pat. Nos. 3,939,075 and 4,105,279 to Glotin, et al., supra, the lower end of the receptacle is bored and threaded to receive an electrical plug 42 having an upstanding contact member 44, to be described later, to be contacted by the instrument 38. An electrical wire 43 is attached to the outer end of plug 42 and extends to the surface. The instrument 38 has in its lower end a socket which, when the instrument is installed in the receptacle bore 36, telescopes over the upstanding contact member 44 while the snap ring 46 carried on the instrument 38 snaps into an internal annular recess 50 provided in the receptacle bore. The instrument 38 has at least one lateral port 52 near its upper end for admitting well fluids from the tuoing bore into the instrument where suitable sensor means (not shown) is provided.

The side pocket mandrel 30 while similar to several of those disclosed in the prior art mentioned hereinabove, but has no lateral port as do conventional side pocket mandrels. Thus, neither the main bore 32 nor the receptacle bore 36 communicates with the exterior of the side pocket mandrel. This special side pocket mandrel 30 complete with the electrical plug 42, contact 44, and the means for adapting the instrument 38 to this equipment, as well as the kickover tool and running tool for installing and removing the instrument in the well, may be furnished by Otis Engineering Corporation, Dallas, Tex.

The electrical wire 43 has its surface end connected to suitable surface equipment, represented by the box 55. Equipment 55 includes a source of electrical energy whereby power may be transmitted via wire 43 plug 42, and contact 44 to the downhole instrument 38. The instrument 38, then senses the parameter or parameters to be monitored and sends electrical signals back to the surface via wire 43. Equipment 55 includes means for processing such signals for immediate display, recording, or the like.

Thus, whether the well is flowing, or not flowing, so long as electrical power is supplied to instrument 38, it will transmit electrical impulses to the surface to indicate the pressure, and/or temperature, or the like parameter, at the location of the instrument in the well. The instrument will ordinarily be programmed to sample the pressure, and/or temperature, or the like, at perhaps closely spaced time intervals and to send appropriate signals to the surface each time a parameter is sampled. Thus, monitoring is virtually instantaneous and in real time. Any change in the parameter being monitored may be immediately reflected at the surface.

Figure 2A:
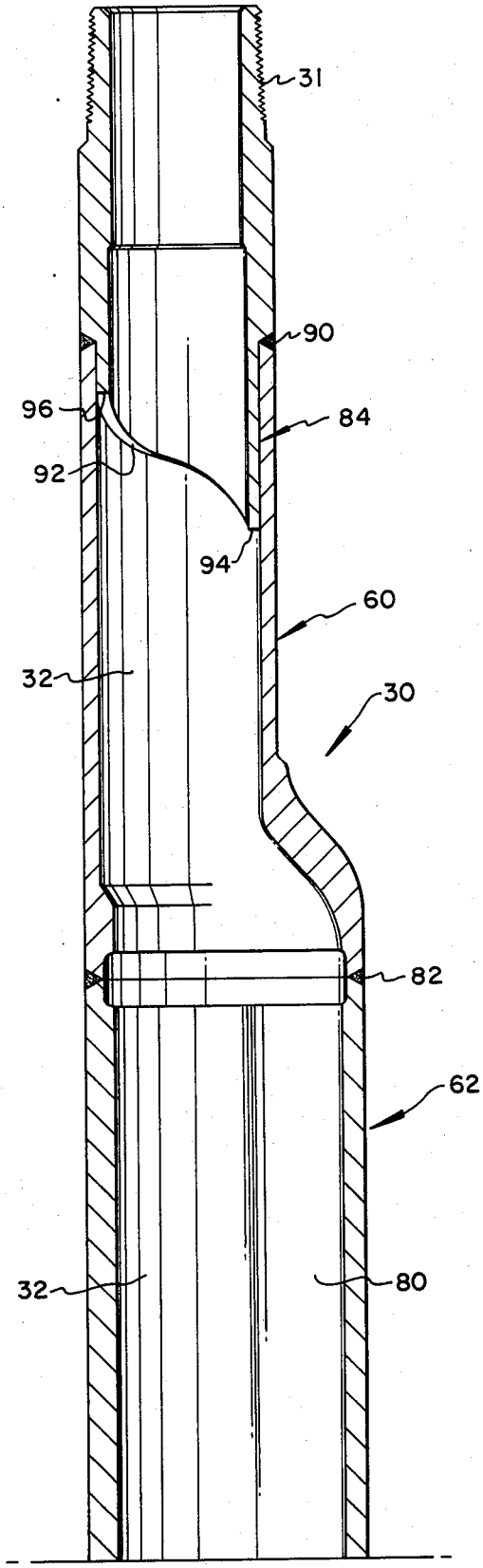
FIGS. 2A, 2B, and 2C, taken together, constitute a longitudinal sectional view showing a receptacle for installation in a well and showing a monitoring instrument in operating position therein.
Figure 2B:
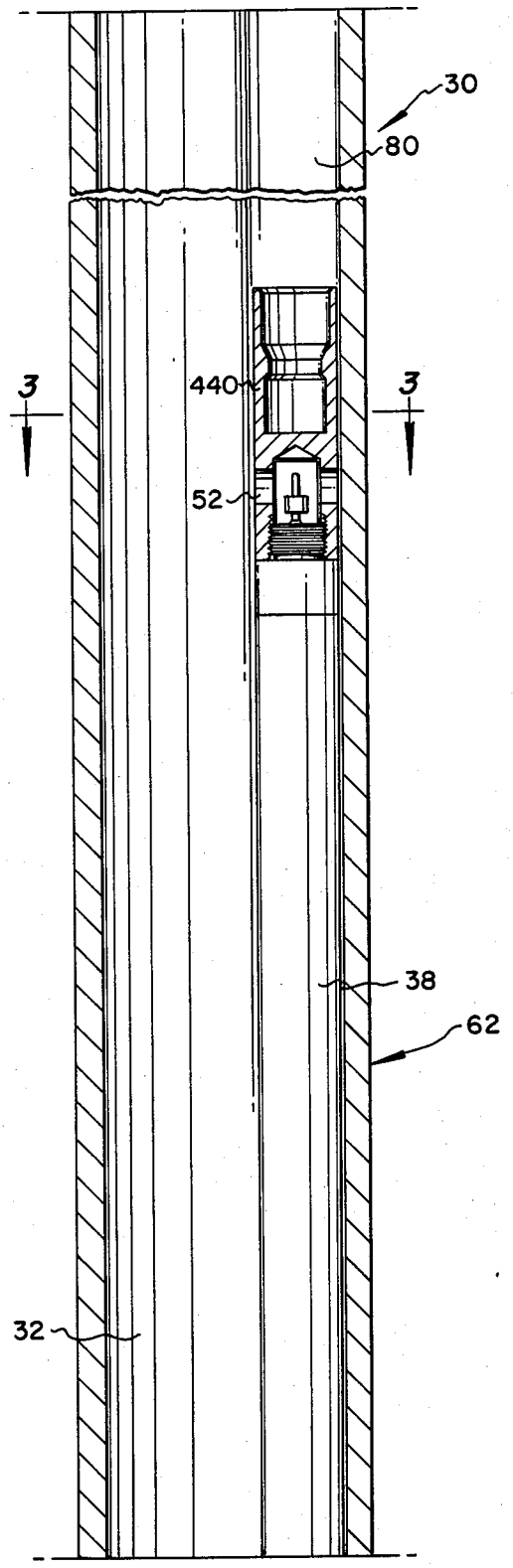
Figure 2C:
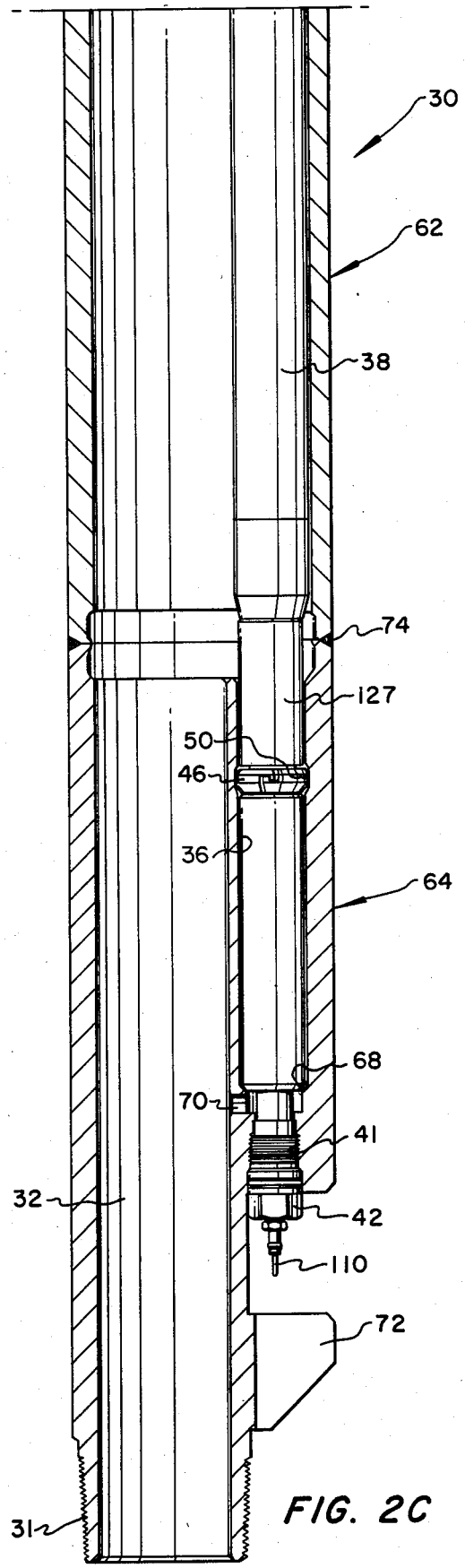

Refering now to FIGS. 2A, 2B, and 2C, the side pocket mandrel 30 and instrument 38 are seen to be illustrated in greater detail.

The side pocket mandrel 30 is provided with means such as thread 31 at its upper and lower ends for attachment to the well tubing 24. A main bore 32 extends the full length of the mandrel 30 and is coextensive with the flow passage 27 througn the well tubing. The side pocket mandrel is constructed in a manner very similar to that taught in U.S. Pat. Nos. 4,333,527 and 4,416,330, supra. It is formed of an upper end piece 60, an upper body section 62, and a lower body section 64.

The lower body section is formed of a solid bar of steel or from an extrusion. If formed from a solid bar, the main bore 32 must be machined, drilled, or similarly fashioned. If material for this lower body section is formed by extrusion, the main bore 32 may be formed during the extrusion process. The receptacle bore 36 is then machined substantially parallel to main bore 32 as shown, and so are the other elements thereof, such as the snap ring recess 50, the upwardly facing seat shoulder 68, the threaded opening 41, the drain port 70, the protective lugs, the lower thread 31, and the special shape required for completing the circumferential weld 74. The receptacle bore 36 is provided with no lateral port means other than drain port 70 and is otherwise imperforate intermediate its ends and, thus, the interior of the side pocket mandrel 30 has no fluid communication with the exterior thereof.

Figure 3:
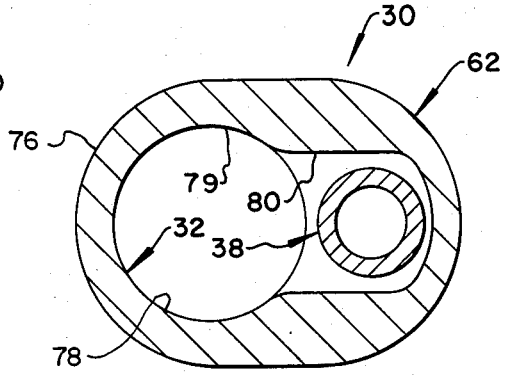
FIG. 3 is a cross-sectional view taken along line 3—3 of FIG. 2B.

The upper body section 62 may be formed from a solid bar of steel, but is preferably formed from an extrusion. A transverse section of this upper body section is seen in FIG. 3. It is seen in FIG. 3 that the outer shape 76 in the upper body section 62 is generally oval, however, a round outer shape may be preferred in large sizes of mandrels if great pressures are to be withstood. The inner shape 78 is much like a cylindrical bore portion 79 with a large longitudinal channel or keyway 80 (as taught in U.S. Pat. No. 4,416,330 to Merritt, et al.) opening thereinto as shown. Tne keyway 80 is offset from the main bore and, in this case houses the instrument 38 in an out-of-the-way location. In addition, the keyway while being of sufficient section to accept the instrument, is sufficiently narrow to protect it from being struck by most ordinary tools which may be lowered into the well tubing. In addition, the upper body section 62 is sufficiently long to accomodate any instrument, such as instrument 38, presently available to the industry.

The upper and lower ends of the upper body section 62 are prepared for welding preferably in the manner taught in U.S. Pat. No. 4,333,527, supra. Its lower end is welded as at 74 to the upper end of the lower body section 64, as before explained. The upper end of the upper body section 62 is circumferentially welded at its 82 to the lower end of the upper end piece 60 after it has been suitably prepared to be so welded.

The upper end piece 60 may, if it is desired to provide means for actuating an orienting kickover tool therein, is provided with an orienting sleeve, such as the orienting sleeve 84. This orienting sleeve 84 may be formed and secured in position in any suitable manner. In the illustrated structure, the sleeve is formed as a separate piece which is then circumferentially welded as at 90 to the upper end of the upper end piece. The orienting sleeve is provided with a pair of guide surfaces 92 which extend from a point 94 upwardly to a high point 96 which may be located 180 degrees from point 94. The two guide surfaces may proceed along right-hand and left-hand helical paths to arrive at the high point 96. The high point is thus shaped like a notch and provides a downwardly facing shoulder 96 to be engaged by an orienting key of a kickover tool for actuation thereof in the well known manner, but which will be explained briefly herein below. The upper end of the orienting sleeve is threaded as at 31 for attachment to the well tubing as before explained.

Figure 4:
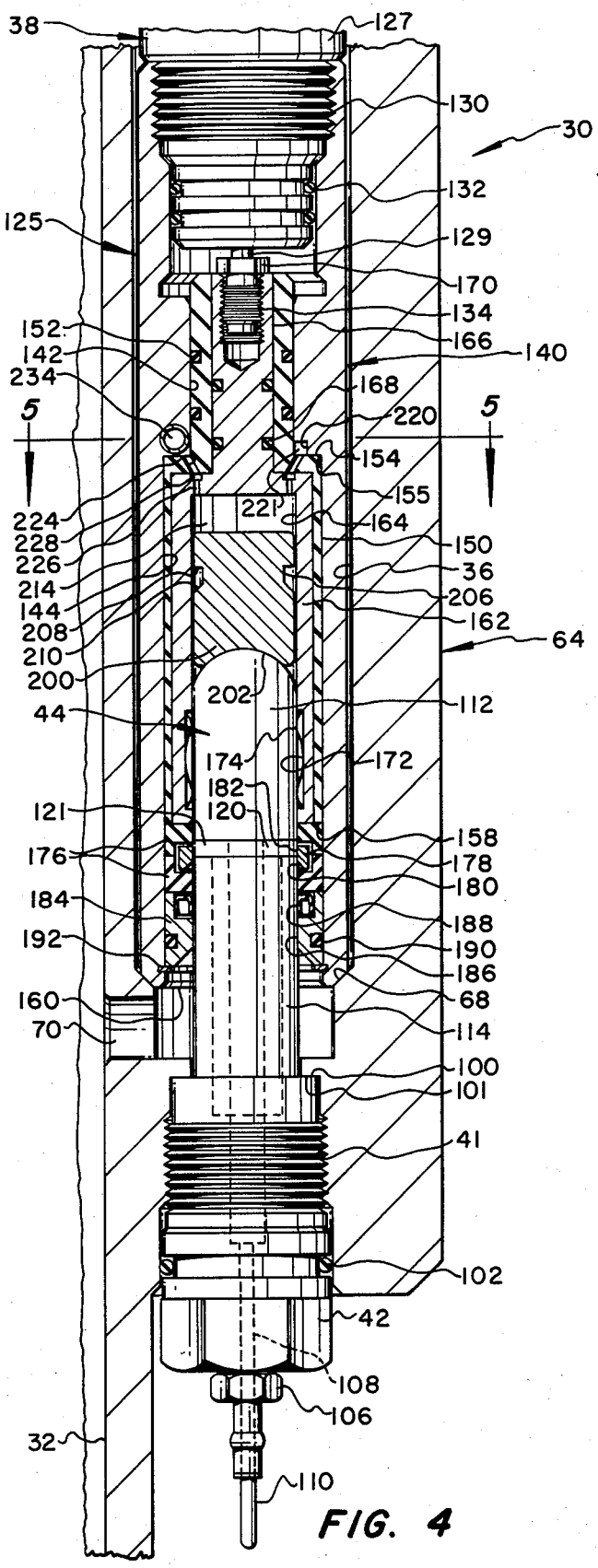
FIG. 4 is a fragmentary longitudinal sectional view showing the electrical connection between the instrument and the receptacle.

The electrical contacts of the side pocket mandrel 30 and the instrument 38 are shown in greater detail in FIG. 4. Refering now to FIG. 4, the electrical plug 42 is secured as by threads 41 in the lower end of the receptacle bore 36 of side pocket mandrel 30 and its upwardly facing seating shoulder 100 is tightened firmly against downwardly facing seating shoulder 101 forming a conventional metal-to-metal seal. A resilient ring, such as o-ring 102 seals about the plug as shown. A connector 106 provides a conductor rod 108 which has its external end exposed as at 110 to be attached to a suitable conductor, such as conductor wire 43, by a suitable connector, sucn as a snap-on connector (not shown), while its internal end is attached to, or is integral with male contacr member 112. The plug 42 has its upper end portion reduced in outside diameter as at 114 and an insulating sleeve 120, having an external flange 121 at its upper end, and formed of a suitable plastic having desired dilectric properties, is disposed between the plug 42 and the male contact member 112 to avoid shunting or short circuiting therebetween and, thus, causing the installation to malfunction.

Thus, an upstanding contact member 44 is provided at the lower end of the receptacle bore. A drain port 70 communicates the receptacle bore 36 with the mandrel's main bore 32 as shown to allow proper drainage and free passage of fluids and solid particles carried thereby.

The female portion 125 of the electrical connector is carried on the extreme lower end of the instrument 38. The instrument 38 is connected to this female portion 125 of this connector by a coupler 127 having electrical conductor means 129 extending therethrough to electrically connect the instrument 38 to the female portion 125 of the electrical connector. The coupler is attached between the instrument and the electrical connector by threads 130 and is sealed by resilient seal rings 132. The electrical conductor 129 of the coupler 127 is preferably spring loaded and its lower end is firmly pressed into a recess or blind hole in the upper end of contact plug 134 and shouldered therein to assure good and uninterrupted electrical contact.

The coupler 127 is provided with a suitable external annular recess 50 in which the snap ring 46 (see FIG. 2C) is carried and by which the instrument is retained in position in the receptacle bore 36.

The female portion 125 of the connector includes a housing 140 having a bore 142 therethrough. Bore 142 is enlarged and threaded at its upper end as at 130 for attachment of coupler 125. Bore 142 nas its lower portion enlarged as at 144. Within bore 142 and its lower enlarged portion 144, a female electrical receptacle is provided, which will now be described.

An insulating sleeve 150 is placed within the body 140 and a pair of resilient seal rings 152 seal between the body and the insulating sleeve as shown. An external annular shoulder 154 on the sleeve engages a corresponding downwardly facing shoulder 155 to limit upward movement of the sleeve 150 in the housing. The lower end 158 of the sleeve, as seen in FIG. 4 is spaced a short distance from the lower end 160 of the housing.

A conductor socket member 162 is positioned inside the insulating sleeve 150 as shown. This member has a downward-opening blind bore 164 for receiving the upstanding contact member 44 of the mandrel in a manner to be explained. Just above the point where bore 164 terminates, the conductor socket member 162 is reduced in outside diameter as at 166 and this reduced diameter portion has a pair of seal ring recesses formed therein in which resilient seal rings 168 are disposed to sealingly engage the inner wall of insulating sleeve 150 as clearly seen in FIG. 4. The upper end of member 162 is drilled and threaded for attachment of plug 170. Plug 170 is provided with a suitable recess or bore for receiving the lower end of spring-loaded conductor rod 129 of coupler 127 as explained earlier.

Near its lower end, conductor socket member 162 is formed with an internal annular recess 172 in which is disposed a contact member 174 which is formed of spring brass or other suitable conductive material and may be gold plated if desired. This member is snaped to be an interference fit with the upstanding conductor member 44 and its springiness assures good contact with both the member 44 and the conductor socket 162.

The lower end of the conductor socket member 162 is substantially even with the lower end of the insulating sleeve 150. Below their lower ends is a pair of insulator rings 176 which may be shaped identically and when assembled as shown provide an internal annular recess in which is positioned a snap ring 178 having its bore chamfered at its lower end as shown to provide a cam shoulder 180 while the upper end of its bore is left unchamfered to provide a square stop shoulder 182. The purpose of this snap ring 178 will be later brought to light.

Below the pair of insulator rings 176, a ring 184 is positioned in the enlarged bore 144 of the housing 140. This ring 184 has a bore 186 enlarged at its upper end as shown to receive and house a one-way seal ring 188. The ring 184 is formed with an external recess in which is disposed a seal ring such as o-ring 190 for sealingly engaging the inner wall of the housing as shown. Tne ring 184 is retained in place by a retaining ring 192 engaged in a suitable internal annular groove in the inner wall of the housing 140 as seen in the drawing. The ring 184, the insulator rings 176, and the snap ring 178 each have a central opening for receiving the upstanding contact member 44 as shown.

In order to assure good, clean contact between the instrument 38 and the upstanding conductor member 44, well fluids, salt water, mud, acids, and other unclean and/or non-insulating liquids must be excluded from the contact areas at the time that the instrument is installed and the lower open end of the instrument is telescoped down over the upstanding contact member 44 in the lower end of the receptacle bore 36 in the side pocket mandrel. Means for accomplishing such good, clean connection are provided and will here be explained.

A piston 200 is slidably disposed in the bore 164 of the conductor sleeve 162. This piston has a concave lower surface 202 which conforms substantially to the rounded upper end surface of contact member 44 and the lower outer edge of the piston is rounded to form an annular cam surface which will allow the lower end of the piston to pass through snap ring 178, the inside dimension of the snap ring being inherently smaller than the outer diameter of the piston but being expandable or spreadable to accommodate the piston. The piston 200 is formed with an external annular recess 206 thereabout. This recess has its upper wall normal to the piston's longitudinal axis, thus forming a square downwardly facing shoulder 208. The lower wall of this recess is beveled as at 210 to provide a cam shoulder. When the instrument is being lowered into the well, the piston 200 is held in its lower position (now shown) by the snap ring 178 engaged in its external recess 206. Thus, it is supported against further downward movement since the square shoulder 182 at the upper corner of the snap ring 178 engages the square shoulder at the upper side of recess 206 on the piston to define its initial lower position.

The cavity or space 214 in the bore 164 above piston 200 is filled completely with clean, non-conducting liquid such as a silicone liquid or a suitable non-conductive grease. It may be desirable for the density of this liquid to be slightly less than that of the well liquids to be encountered. The liquid in space 214 will then be buoyed upward and will be retained in its place more readily. When the piston 200 is in its initial lower position (not shown) and held in place by snap ring 178, the periphery of the lower portion of the piston is engaged by one-way seal ring 188 to discourage the non-conducting fluid from migrating out of its place in the instrument.

When the instrument 38 is forced down into the receptacle bore 36, the lower open end of the instrument starts to telescope over the upstanding contact member 44. The member 44 immediately engages the lower end of the piston. As the instrument is forced further downward, the fluid above the piston is compressed and then displaced. Space 214 is closed above the piston. The only route of escape for the insulating fluid is downward about the piston, and to do this the liquid must be forced downward between the piston and the one-way seal ring 188. As the non-conducting liquid is thus displaced, its displaces ahead of it all other liquids, oil, salt water, water, mud, and the like, so that when the instrument is fully seated, as seen in FIG. 4, there will be good, clean contact between the contact member 174 and the contact area of the male contact member 112. In addition to the washing action just mentioned, the contact areas are wiped clean as the mating parts are telescoped together.

Downward movement of the instrument relative to said side pocket mandrel is arrested when the lower end 160 of the instrument 38 engages upwardly facing inclined shoulder 68 in the receptacle bore 36.

In order to facilitate the disconnection of the instrument 38 from the upstanding male contact member 44, means are preferably provided for allowing well fluids to re-enter the space 214. Since the one-way seal 188 will not allow fluids to re-enter the space 214, other means of re-entry are needed.

The housing 140 is provided with a passageway communicating the upper end of space 214 with the exterior of the instrument 38 as will be described, and this passageway has a check valve therein which will permit fluids to pass inwardly therethrough but will not allow fluids to move therethrough in an outward direction.

At the level of the downwardly facing shoulder 155 in the body, the body is provided with a short intermediate bore 220. This short bore understandably provides an annular recess 221 which may be better seen in FIG. 5. This recess 221 is in direct fluid communication with the space 214 above piston 200 via a plurality of holes 224, through the insulator sleeve 150, and a plurality of holes 226 in the conductor sleeve 162, as shown. An annular recess 228 is formed in the conductor sleeve to facilitate the movement of fluids between holes 224 and 226.

The body 140 is provided witn a passage through its wall to fluidly communicate recess 221 with the exterior of the housing. This passage is provided in the form of an off-center transverse hole 230 which is clearly seen in FIG. 5. One end of hole 230 is plugged by suitable means, such as screw 232. A check valve assembly 234 in passage 230 permits the flow of fluids into the interior of housing 140 as indicated by the arrows but will not permit outward flow therefrom.

Figure 5:
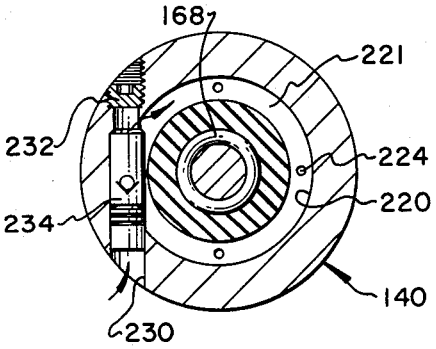
FIG. 5 is a cross-sectional view taken along line 5—5 of FIG. 4.

The check valve, such as check valve assembly 234, may be of the type which is swaged into place. Such precision check valves and swaging tools are available from The Lee Co., Westbrook, Conn. The symbol for a check valve has been superimposed upon check valve assembly 234 as seen in FIG. 5 to further indicate its function.

Thus, when piston 200 is moved upwardly in the bore 164 of the conductor sleeve 162 as a result of the lower open end of the instrument being telescoped down over the upstanding contact member 44, the non-conducting liquid above the piston cannot flow through check valve assembly 234 so it must flow downwardly around the piston and the upstanding contact member 44. This washes the well fluids, oil, salt water, and the like substances, out of the contact area as before explained. When, however, the instrument 38 is lifted relative to the upstanding contact member, well fluids will flow from the exterior of the instrument, through passage 230 and check valve assembly 234, into recess 221. From there it flows through holes 224, recess 228, and holes 226 into space 214 to fill the void created by such upward movement of the instrument relative to the upstanding contact member. This facilitates making the disconnect for removal of the instrument from the well.

The instrument is installed in and removed from the side pocket mandrel 30 through use of a suitable kickover tool lowered into the well by suitable means, such as a wire line (not shown) and a string of wireline tools (not shown). Wireline and wireline tools are well known and have been used for many years to install subsurface flow controls, safety devices, and other well tools in wells.

Although existing kickover tools might be used to install an instrument, such as instrument 38, in the side pocket mandrel 30 of well 20, the kickover tool of FIGS. 6A–10B is particularly suitable for this task and has special features which will handle the very expensive and delicate instrument with a good degree of safety.

Referring now to FIGS. 6A through 10B, it will be seen that the kickover tool of this invention is indicated generally by the reference numeral 300. Kickover tool 300 is similar to the kickover tool disclosed in the above-mentioned U.S. Pat. No. 4,442,893 to Foust, which patent is incorporated herein by reference for all purposes.

Kickover tool 300 includes an elongate body 302 having means, such as thread 304 on its upper end for attachment to a tool train such as tool train 306. Body 302 has a flat surface 310 which extends from its lower end 311 to a location near its upper end where it meets abrupt downwardly facing shoulder 312. Body 302 is formed with a longitudinally extending slot 314 which is enlarged as at 316.

An elongate actuator 320 has a flat side 322 which extends from its upper end downward almost to its lower end. The body 302 and the actuator are assembled as shown with their flat sides 310 and 322 in confronting relation and a shoulder bolt 324 passes through slot 314 of the body and is tightened in threaded aperture 326 of the actuator 320, as shown, to hold the body and actuator in close but freely sliding relationship. The head of bolt 324 slides in the enlarged portion 316 of slot 314. The actuator is slidable between an upper position, seen in FIG. 6A wherein the upper end of the actuator abuts or substantially abuts the downwardly facing shoulder 312 at the upper end of body flat 310.

Figure 6A:
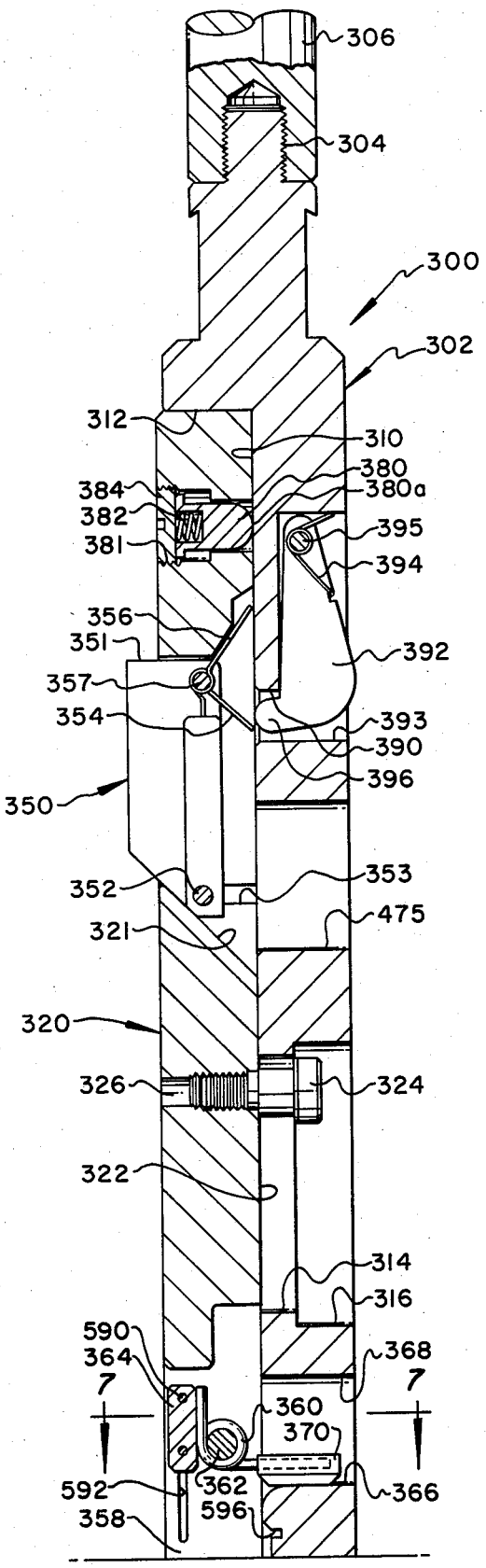
FIGS. 6A, 6B, and 6C, taken together, constitute a longitudinal view, partly in section and partly in elevation showing the kickover tool and running tool of this invention as they would appear while lowering an instrument into a well.

A pivot arm 330 is pivotally attached as by pivot pin 332 to the lower bifurcated end of body 302 and tool carrier means 335 is hingedly attached as by pivot pin 336 to its free or lower end as seen in FIG. 6A. The inner end of pivot arm 330 is formed with slot means 338 which is engaged with pin 340 carried on the actuator 320. It may now be readily seen that when the actuator 320 moves downwardly relative to the body 302, the pin 340, moving downwardly relative to the pivot arm 330, will cause the pivot arm to pivot about pivot pin 332 in a counter-clockwise direction. When actuator 320 reaches its lowermost position, seen in FIGS. 8A and 8B, the pivot arm will be in its kickover position wherein its free end extends outwardly from the body at substantially 90 degrees, as shown. As the pivot arm swings outwardly toward kickover position, the tool carrier means 335, being hinged thereto remains in a pendent position as seen. Thus, as the pivot arm pivots to misaligned position the tool carrier means pivots in a clockwise position and thus remains substantially parallel to the longitudinal axis of the kickover tool. In FIGS. 6A–8B, the tool carrier means includes a carrier 344 and a running tool 346 from which is suspended an instrument 38 which may be like the instrument 38 previously introduced for monitoring the well pressure and/or temperature.

Figure 6B:
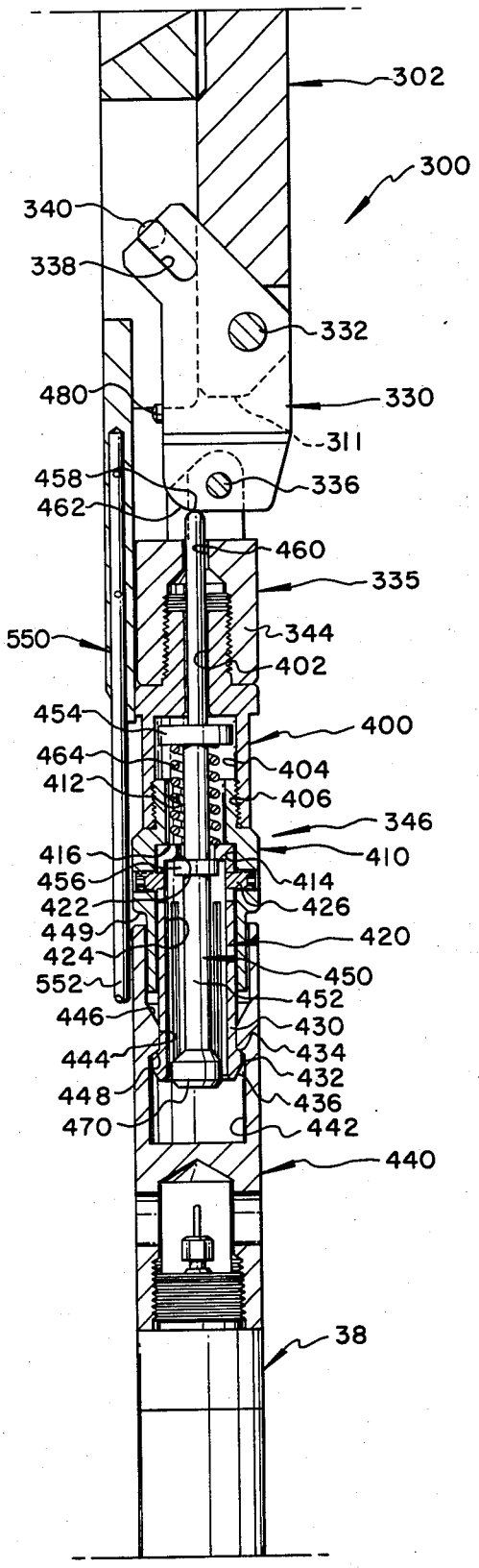
Figure 6C:
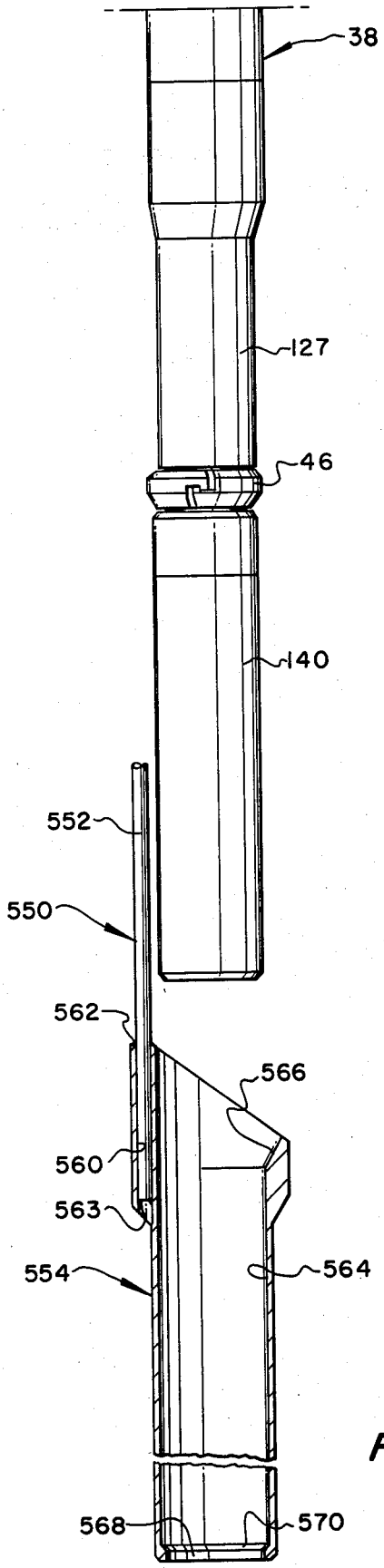
Figure 7:
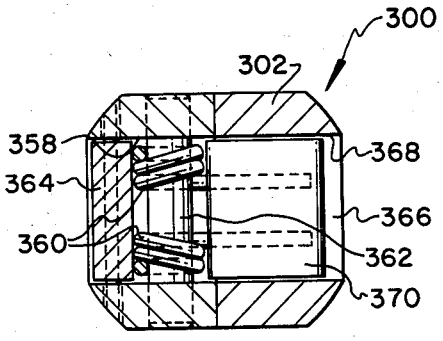
FIG. 7 is a cross-sectional view taken along line 7—7 of FIG. 6A.
Figure 9:
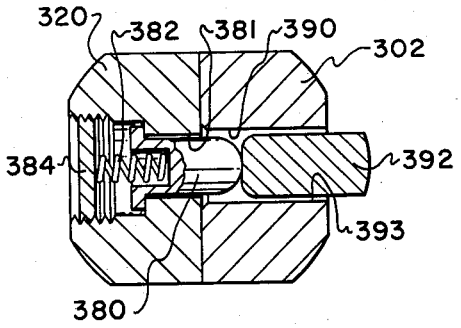
FIG. 9 is a cross-sectional view taken along line 9—9 of FIG. 8A.

It is readily seen that when the kickover tool 300 is actuated, as by moving the actuator 320 thereof downward relative to its body 302, the tool carrier means and instrument are moved from a running position wherein they are axially aligned with the kickover tool, and therefore with the tubing bore as seen in FIG. 6A–6C, to a kickover or misaligned position wherein the tool carrier means and the instrument are laterally displaced to a position of axial alignment with the offset receptacle bore 36 of the side pocket mandrel 30.

The kickover tool 300 is provided with an orienting finger or key 350, having a square upwardly facing end 351, and attached as with pin 352 which has its ends slidable in a suitable slot such as slot 353 formed in actuator 320. The key 350 can pivot about pin 352 and the pin can slide in slot 353 as needed. The orienting key is initially biased outwardly by spring means inlcuding a first spring 354 and a second spring 356 which provides a lesser bias than does the first spring. Both springs, 354 and 356 are wound about pin 357 whicn is carried in a suitable aperture of orienting key 350 as shown. In an emergency, a large force applied to the orienting key as by the key repeatedly engaging stop shoulder 96 in the mandrel, the pin 352 will shear and as the key moves downwardly relative to the actuator, the cam surface 321 will force the orienting key to fully retracted position.

In addition detent means are provided for detenting the actuator 320 in its uppermost and also in its lowermost position relative to the body 302.

A pair of detent springs 360, disposed in slot 358 of the actuator, is wound around pin 362 and each spring has one of its ends supported against stop block 364 while its other end applies a downward force to the upwardly facing surface 366 at the lower end of slot 368 in body 302 as seen in FIG. 6. See also FIG. 7. It may be desirable to provide means such as cam block 370 on the end of the springs 360 as shown to provide better bearing area and improve the operation of the tool. By applying a downward force to surface 366 of the body, the springs 360 also apply an upward force to pin 362 which tends to lift the actuator and maintain it in its uppermost position relative to body 302.

The kickover tool as seen in FIGS. 6A–6C is lowered into the well tubing 24 as through use of a wireline and tool string until upwardly facing shoulder 351 of the orienting key 350 is below the guide surface 92 of orienting sleeve 84 in the side pocket mandrel 30. The kickover tool is then lifted with care. The shoulder 351 of orienting key 350, which is spring-pressed outwardly, will engage the guide surface 92 of the orienting sleeve 84 and will follow it, rotating the kickover tool about its longitudinal axis until the orienting key engages the apex indicated by downwardly facing shoulder 96 of the orienting sleeve and can advance upwardly no farther. Further lifting causes the body 302 to move upwardly relative to actuator 320, overcoming the detent force of detent springs 360. As this relative longitudinal movement occurs between the actuator and body, the pivot arm 330 is swung outwardly and the tool carrier means 335 and instrument 38 are moved to a laterally displaced or offset position, seen in FIG. 8B. In this offset position the tool carrier means and instrument are outside the main bore 32 of the side pocket mandrel and are within the vertical channel 80 where they are suspended poised above the open upper end of the receptacle bore 36.

Figure 8A:
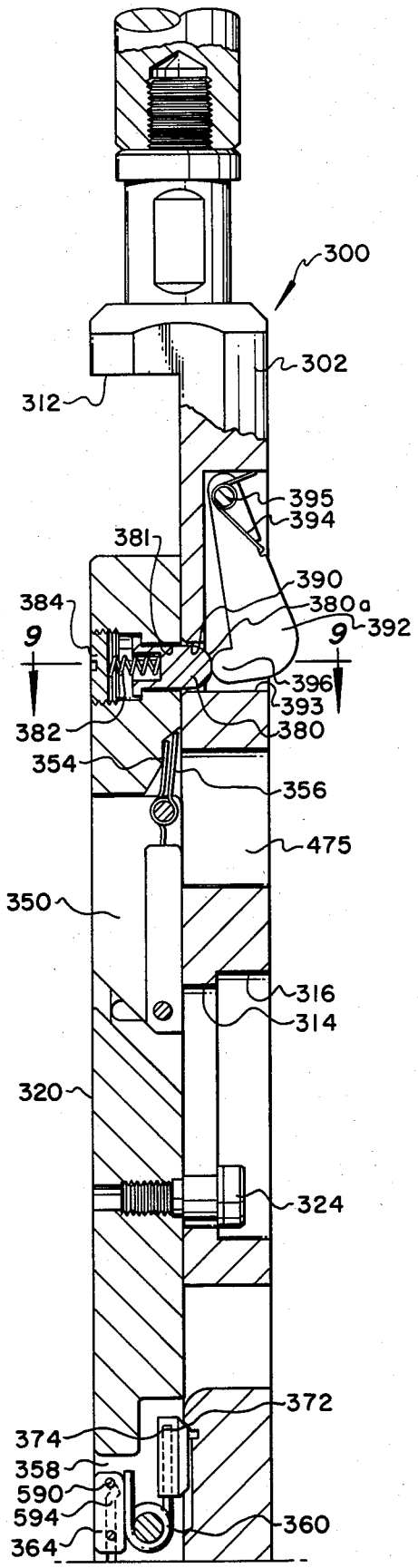
FIGS. 8A and 8B, taken together, constitute a fragmentary longitudinal sectional view of the kickover tool and running tool of FIGS. 6A, 6B, and 6C in misaligned kickover position supporting the instrument in a laterally displaced position.

When the body 302 was lifted to its uppermost position relative to the actuator 320, the cam block 370 on detent spring 360 snapped into its position shown in FIG. 8A wherein its upper cam shoulder 372 engaged a corresponding cam shoulder 374 on the actuator 320 to detent or latch the actuator in its fully actuated position.

At the same time, wnen the body 302 reacned its uppermost position relative to the actuator, other means became effective to positively lock the kickover tool in its fully actuated position. This lock means includes a lock plunger 380, having a rounded nose **380*a* slidable in aperture 381, and which is biased inwardly by a spring 382 retained in place by a screw 384 engaged in the enlarged and threaded aperture 381. When the spring 382 moves the plunger to its innermost position, seen in FIG. 8A, the plunger will extend beyond the flat surface 322 of the actuator. When the actuator 320 reaches its lowermost position relative to the body 302, a hole 390 in the body aligns with the aperture 381 of the actuator and the plunger 380 is forced by spring 382** to enter into hole 390 of the body. The actuator and body are thus locked together and there can be no relative longitudinal sliding movement between them until the plunger 380 is retracted or displaced from hole 390. This can only happen after the kickover tool has been fully actuated to align hole 390 with the lock plunger 380 and after the kickover tool has been lowered into the side pocket mandrel 30 sufficiently to allow the release lever 392 to move outward of the kickover tool considerably further than the confining bore 37 of the well tubing 24 will allow. The channel 80 in the side pocket mandrel provides room for this to occur.

Figure 10A:
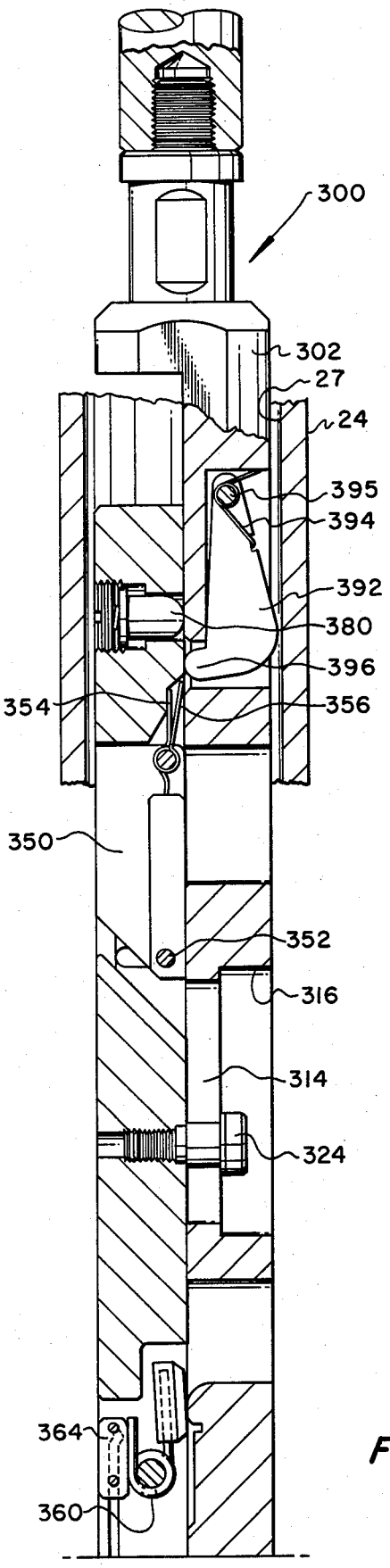
FIGS. 10A and 10B, taken together, constitute a view similar to FIGS. 8A and 8B, but showing the kickover tool being restored to aligned position as it is lifted out of the side pocket mandrel of FIGS. 2A, 2B, and 2C.

It is clearly shown in FIGS. 6A, 9A, and 10A, that a release lever 392 disposed in slot 393 of body 302 is pivotally mounted to the body. Lever 392 is biased toward retracted position by spring 394 wound around pivot pin 395 by which lever 392 is pivotally mounted. A projection or finger 396 is formed on the lower end of the lever 392 as shown and when this lever swings in a clockwise direction the finger 396 is able to project into hole 390. Lever 392 is normally held retracted by spring 394 so that it will not become unduly worn by being bragged along the inner wall of the tubing. Wnen the kickover tool is thus in the bore of the tubing, the confining wall of the tubing will not allow lever 392 to move outward sufficient to clear the hole 390. At such time, the lock plunger 380 cannot engage in the nole 390 even though the hole and plunger may be aligned, as when the kickover tool is at first fully actuated and the orienting key 350 is still at or near downwardly facing shoulder 96 of the orienting sleeve. If, however, the kickover tool is lowered slightly, while in the actuated condition, to a position, seen in FIGS. 8A–8B, wherein lever 392 is no longer confined by the tubing bore, but is able to move outward into the enlarged cavity of the side pocket mandrel, that is, into channel 80, the spring 382 being stronger than spring 394 can force the lock plunger 380 into hole 390 and displace the lever 392 as it is forced to pivot in a counterclockwise direction and thus protrude much farther beyond the periphery of the kickover tool. The presence of lock plunger 380 in the hole 390 will prevent relative longitudinal movement between the body and actuator and thus releasably lock them in actuated relation. Thus securely locked, the kickover tool may transmit upward or downward forces to the instrument through its pivot arm extended at substantially 90 degrees and througn the running tool attached thereto by the tool carrier.

When the kickover tool is lifted so that lever 392 re-enters the confining main bore at the upper end of the side pocket mandrel, lever 392 will engage the inner wall 27 of the tubing 24 and will be cammed inwardly, displacing the lock plunger 380 to a position where it no longer is engaged in hole 390 and, thus, cannot prevent relative longitudinal movement of the actuator relative to the body. Thus, this lock becomes automatically released responsive to lifting the kickover tool from the side pocket mandrel.

During withdrawal of the kickover tool from the side pocket mandrel, the pivot arm must be returned to its aligned, or FIG. 6B, position. Since the lock plunger 380 has already been released or retracted from hole 390, the pivot arm will be forced to aligned position when its outer end engages the restriction as at 398 near the top of the side pocket mandrel. As the kickover tool is again in its FIG. 6A–6C position, the detent spring 360 will again be effective to maintain the kickover tool in that position.

The running tool 346 attacned to the outer end of pivot arm 330 releasably attaches the instrument 38 to the kickover tool 30.

The running tool 346 includes a top sub 400 having a bore 402 whicn is enlarged as at 404 and threaded as at 406 for attachment to the upper end of body or housing 410. Body 410 has a bore 412 which is enlarged as at 414 providing a downwardly facing internal annular shoulder 416 whose purpose will be later explained.

A collet 420 having a bore 422 which is enlarged as at 424 is disposed in the enlarged bore 414 of housing 410, and its upper end may abutt downwardly facing internal shoulder 416 as shown. Collet 420 is secured in position within the body by some suitable means such as pins, screws, or the like, so that it may be readily and more economically replaced if necessary. As shown, the collet is secured by screws 426 threaded into suitable body apertures and having their inner ends engaged in suitable recesses, holes, or slots formed in the collet.

The collet 420 is formed with a plurality of dependent fingers 430 each having an external boss 432 providing an upwardly facing shoulder 434 which is inclined upwardly and inwardly and a downwardly facing shoulder 436 which is inclined downwardly and inwardly. The upwardly facing shoulder 434 is more abrupt than is the downwardly facing shoulder 436 for a purpose to be described. The collet fingers releasably engage the instrument 38 as shown. The instrument is provided with an upper end member 440 having an upwardly opening blind bore 442 having in internal annular ridge or flange 444 constituting what is commonly termed an "internal fishing neck". This fishing neck provides an upwardly facing shoulder 446 which is inclined downwardly and inwardly and a downwardly facing shoulder 448 which is inclined upwardly and inwardly as shown. The downwardly facing shoulder 448 is more abrupt than is the upwardly facing shoulder 446. Thus, the collet fingers may be moved into engagement with the internal fishing neck of the instrument with somewhat less force than that required to disengage it.

Body 410 of the pulling tool is formed with an external downwardly facing shoulder 449 which is engageable with the upper end of the instrument 38 to limit the downward movement of the collet relative thereto.

To lock the collet fingers engaged in the instrument and to unlock them, a control rod and spring are used, as will now be explained.

A control rod 450 is disposed within the pulling tool 346. The control rod comprises a rod body 452 having a large external upper flange 454 and a smaller lower external flange 456 intermediate its ends. The upper end of the control rod is rounded as at 458 and protrudes through bore 402 of the upper sub 400 and through bore 460 of the carrier 335 attached to the pivot arm 330 of the kickover tool. The upper end 458 of control rod 450 which protrudes from bore 460 of the carrier is engageable with cam surface 462 formed on the lower corner of the pivot arm as snown. A coil spring 464 is disposed in bore 412 of the pulling tool housing 410 and surrounds control rod 450 between its upper and lower flanges 454 and 456. The lower end of the spring 414 is not supported on lower flange 456 but is supported by the upper end of the collet 420 while its upper end is engaged with the lower side of the control rod upper flange 454 to apply an upward force to the control rod to maintain its rounded upper end 458 in engagement with the cam surface 462 on the pivot arm of the kickover tool.

The lower end of the control rod 450 is enlarged to provide a knob or expander 470 whose upper and lower edges or corners are preferably chamfered as shown. The knob 470 is small enough to be disposed between the lower ends of the collet fingers 430 as shown in FIG. 6B, yet is sufficiently large in diameter to prevent the lower ends of the collet fingers from being forced inwardly sufficiently to permit them to disengage and be withdrawn from the internal fishing neck of the instrument 38. It may be desirable to form knob 470 as well as upper flange 454 as separate pieces and then fasten them to the control rod by suitable means such as threads, pin, or the like.

Figure 8B:
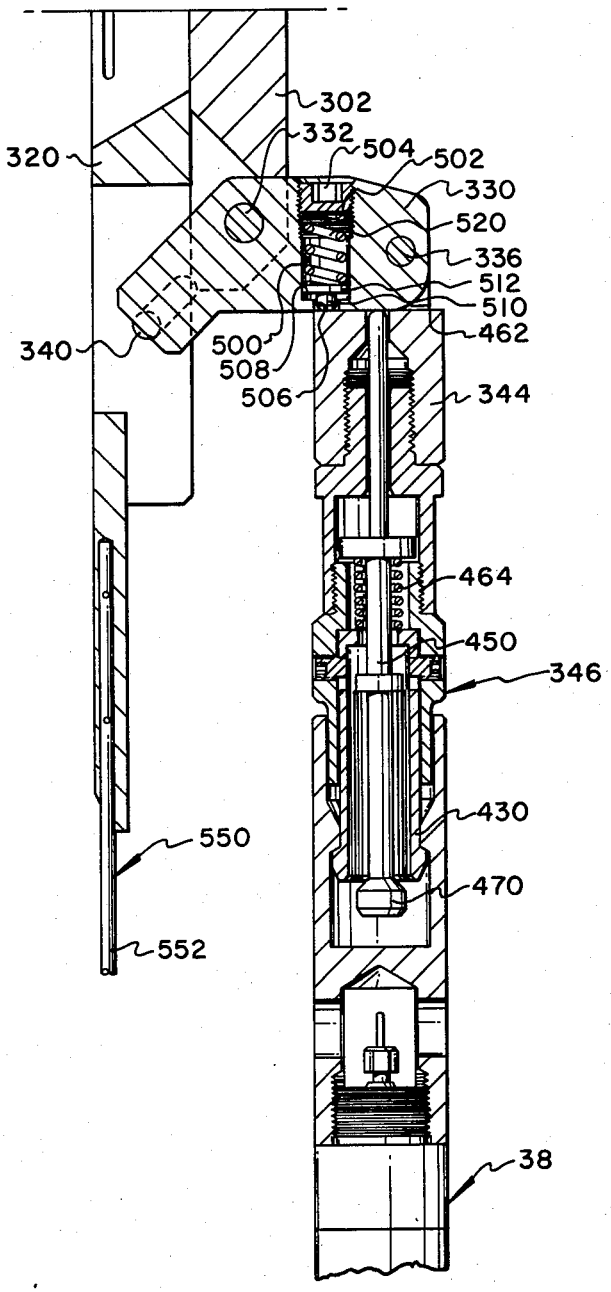

When the kickover tool 300 is actuated from its aligned position, seen in FIGS. 6A–6C, to its kickover position, seen in FIGS. 8A–8B, and the pivot arm 330 is extended at about 90 degrees to the kickover tool while the tool carrier, pulling tool, and instrument remain in their vertical position, the cam surface 462 of the pivot arm will force the control rod 450 of the pulling tool to its lowermost position, seen in FIG. 8B. In the FIG. 8B position, the knob on the lower end of control rod 450 can no longer support the lower ends of the collet fingers against inward movement. In this case, the collet can be disengaged from the instrument by merely lifting the kickover tool provided the instrument is held in the receptacle.

In installing the instrument in the side pocket mandrel, the kickover tool is prepared as seen in FIGS. 6A–6C. In preparation the kickover tool is actuated to swing the pivot arm outward, the carrier is swung downward (clockwise) to its pendent position to move the control rod to its releasing position, the upper end of the instrument is telescoped over the lower end of the collet to attach the instrument to the running tool, the release lever 450 is depressed to unlock the actuator from the body, and then the kickover tool is operated to its running position, as seen in FIGS. 6A–6C, to permit the control rod 450 to move up under the bias of spring 464 to collet locking position, thus securely locking the instrument to the kickover tool.

The kickover tool and instrument are attached to a tool string and lowered into the well to a level where the orienting key is below the orienting sleeve in the side pocket mandrel. The kickover tool is then lifted to engage its orienting key with the orienting sleeve to orient the kickover tool with respect to the receptacle bore and is further lifted to actuate the kickover tool to kickover position. When the kickover tool reaches fully actuated position, the spring 354 will then have space, prov:ded by slot 475 in the body, to allow it to unwind a little as its inner end moves about pin **352*a* until it comes to bear against the actuator. Spring 354, which is stronger than spring 356 now applies an inward bias to orienting key 350 which overcomes the outward bias of spring 356 and causes the key 350 to move to its fully retracted position, seen in FIGS. 8A and 11A**. This is substantially the same procedure taught in U.S. Pat. No. 4,442,893 to Foust, which is incorporated herein for all purposes by reference thereto.

The instrument is now within channel 80 and in alignment with the receptacle bore and can be lowered thereinto. The collet is unlocked, but still supporting the instrument. The kickover tool is lowered. The instrument is forced into the receptacle bore 36. Electrical contact is made. The snap ring 46 on the instrument engages in the receptacle bore lock recess 50 to hold the instrument in place. The kickover tool is lifted to withdraw the collet from the instrument and is withdrawn from the well. After removal of the kickover tool and tool string from the well, the electrical power may be turned on and electrical energy transmitted through wire 43 to instrument 38 downhole. Instrument 38 will utilize this electrical energy and will respond to the well pressure and temperature in the side pocket mandrel. The instrument will then generate appropriate electrical signals which are then transmitted through wire 43 to surface equipment 55 at the surface for processing and subsequent display, readout, and/or storage in a memory bank.

In wells having their bore deviated appreciably from the vertical, it is possible that a side pocket mandrel sucn as the mandrel 300 may be located in such deviated bore. It is further possible that the receptacle bore of such mandrel may be located at the upper side of the mandrel. It may be difficult for the kickover tool to "aim" the instrument into the receptacle bore since because of the slant, the instrument may "sag" as a result of a little slack here and there in the kickover tool and the running tool.

If the kickover tool 30 is to be used in deviated wells, it is highly desirable tnat means be provided to prevent such sagging of the instrument. Such means may include the following means which will now be described.

Figure 10B:
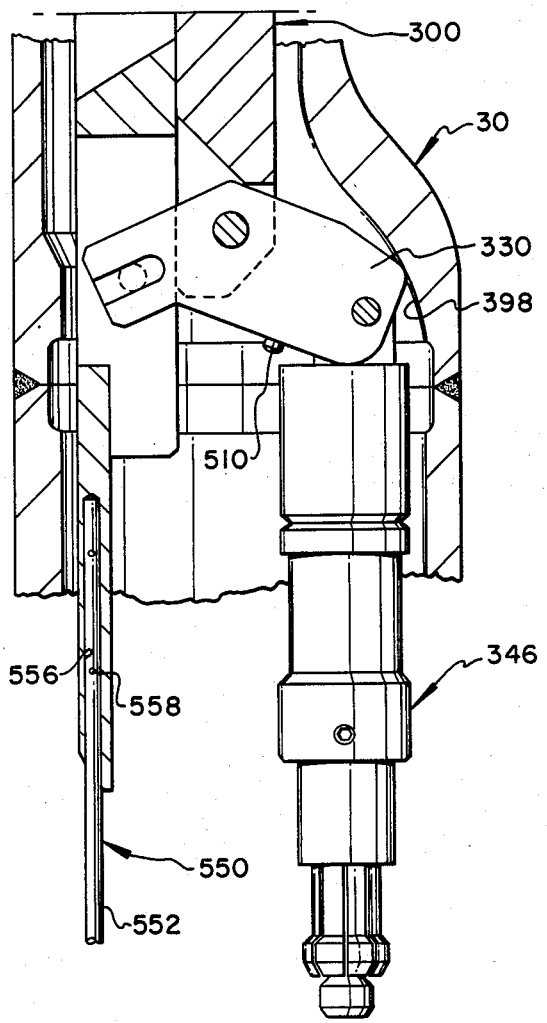

The pivot arm, as shown in FIG. 8B is provided with a cross bore 500 which is threaded as at 502 to receive a plug 504 as shown. The cross bore 500 is reduced as a 506, providing an upwardly facing shoulder 508. A plunger 510 having a flange or head 512 at its upper end is slidably disposed in bore 500 with its lower reduced diameter portion disposed in reduced bore 506. When the plunger 510 has its flange 512 engaged against upwardly facing shoulder 508, the reduced end of the plunger will protrude slightly from the pivot arm, as seen in FIG. 6B and 10B. A coil spring 520 is disposed in bore 500 and has its upper end supported against the inner end of screw 504 while its lower end bears against the head 512 of the plunger. Thus, the spring 520 constantly applies a force to plunger 500 tending to extend it as far as possible.

Plunger 510, as seen in FIG. 8B, is spaced inwardly of pivot pin 336 in the pivot arm. That is to say that the plunger is located between the pivot pin 336 and the pivot pin 332. When the pivot arm is in its kickover or misaligned position, seen in FIG. 8B, the exposed end of plunger 500 will apply a force to carrier 344 tending to rotate it about pivot pin 336 in a counter-clockwise direction. This force will cause the instrument 38 to swing outward away from the kickover tool until its lower portion is against the wall of the side pocket mandrel. The spring 520 should be sufficiently powerful to cause this action even if the side pocket mandrel should be in a horizontal position with the receptacle bore 36 on its upper side. The screw 504 may be used to adjust the loading of spring 520 as desired.

As was mentioned earlier, instrument 38 can be any suitable instrument for monitoring the desired parameter in the well. It is likely that such instrument will monitor both pressure and temperature especially since the pressure sensor will need to be temperature compensated, temperature data can be obtained with little added expense. Some such instruments are very accurate, very sophisticated, and very costly. They may represent a cost of tens of tnousands of dollars. The running tool 346 is designed to install the delicate instrument in the side pocket mandrel gently to avoid damage thereto.

It may be desirable to provide means on the kickover tool for catching the instrument should it accidentally fall free of the running tool. Such means is shown in the drawing and will now be described.

Catcher means 550 is shown depending from actuator 320 in FIGS. 6B, 6C, 8B, and 10B. It includes rod means 552 and container means 554 attached to the lower end of actuator 320. Rod means 552 is shown to comprise a single rod but it could comprise two or possibly three rods of small diameter. The rod or rods should be sufficiently flexible to move freely through tubing which may not be perfectly straight.

Rod 552 has its upper end disposed in a downwardly opening hole 556 in actuator 320, as shown, where it is secured as by one or more pins sucn as pin 558. The lower end of rod 552 is received in the upwardly opening hole 560 of container 554 and is secured therein by suitable means such as weld 562 and/or weld 563.

Rod 552 is sufficiently long to place the open upper end of container 554 a spaced distance below the lower end of the longest instrument when the instrument is carried by the kickover tool. Thus the catcher means will not interfere with the normal operation of the kickover tool or with the process of installing the instrument in or removing it from the offset receptacle bore 36 of a side pocket mandrel.

The container 554 is provided with a bore 564 which is flared at its upper end as at 566 to guide the lower end portion of the instrument thereinto. The bore 564 is reduced in diameter as at 568 to provide an upwardly facing inclined annular no-go shoulder 570 for limiting telescoping movement of the instrument into bore 564. The diameter of bore 564 approximates that of receptacle bore 36 of the side pocket mandrel 30 and will thus support the instrument in an upright aligned position and when the kickover tool is lifted through the well tubing 24, the instrument will be lifted with it. Thus, the very costly instrument which otherwise may have been lost or, at least, severely damaged by dropping free in the well, may be retrieved from the well with ease and without making an extra trip into the well with a retrieving tool.

The instrument 38 may be retrieved from the side pocket mandrel by replacing the running tool with a suitable pulling tool. The running tool 346 can be converted to a pulling tool by pinning the flange 456 onto the control rod 452 with a shearable pin and omitting the screws 426. This converted pulling tool is attached to carrier 335 and lowered into the well on the kickover tool 300. Tne kickover tool is then oriented and actuated in the manner explained hereinbefore. After actuation, the kickover tool is lowered. The lower end of the collet 420 enters the upper open end of the instrument and when the downwardly facing shoulder 436 on the collet fingers 430 engage upwardly facing shoulder 446 in the instrument, downward movement of the collet is arrested. Further lowering of the pulling tool casues the control rod 450 to be further lowered while compressing spring 464. The knob 470 on the lower end of control rod 450 will be moved to a lower position allowing the collet fingers to be cammed inwardly so that their bosses 432 can move downward past internal flange 444 of the instrument. Upon passing this internal flange, the collet fingers will spring back to their normal position, and at the same time, the spring 464 will expand and move the collet downward relative to the control rod to a position where the knob 470 thereon will support the collet fingers against inward movement to their releasing position. The pulling tool is now fully locked to the instrument and lifting the kickover tool will lift the instrument from its place in the side pocket mandrel. Of course, should the instrument be fouled in the receptacle bore 36, an upward pull on the pulling tool of sufficient force will shear the pin holding flange 456 in position on control rod 450 and allow the flange 456 to move downward until it comes to rest upon knob 470. The collet now is supported solely by flange 456 which in turn is supported by knob 470. In this position, the collet finger are positioned far below knob 470 and can be disengaged from the instrument readily by merely lifting the kickover tool with enough force to withdraw the unlocked collet from the instrument.

For the sake of convenience, the stop block 364, which could otherwise be provided in a simpler form, such as a pin, screw, shoulder, or wall, may be provided the form shown in the drawing. As shown in FIGS. 6A, 8A, and 10A, stop block 364 may be slidably mounted on the actuator 320 by a pair of pins, such as pins 590 secured in suitable apertures in the stop block and having their projecting ends engaged in a pair of slots 592 each formed in an opposite wall of larger slot 358. Slot 592, as seen in FIGS. 8A and 10A, runs longitudinally of the actuator 320 and is straight except for a relatively small crook or convolution 594. The extreme upper end of the slot may preferably be in line with the straight portion thereof, as shown.

When it becomes desirable to relieve the load of spring 360, as when it is desired to work on the kickover tool without the detent being a hindrance, the stop block 364 is merely forced downward by placing the blade of a screwdriver in the slot 358 above the stop block and prying downward. As the stop block moves downward, its upper end must move inwardly a litle for a short distance as the upper pin 590 follows the crooked portion of the slot. As the upper pin 590 passes this crooked portion of the slot, the stop block will move readily toward the lower end of the slot as the spring 360 unwinds to relieve its load.

To reload spring 360 and restore the detent to operating condition, stop block 364 must be lifted. To do this, the blade of a screwdriver is placed beneath it and the point of the screwdriver then engaged in the notch 596 formed in actuator 320 slightly below window 366, after which the screwdriver is used to pry and lift the stop block to its upper position seen in the drawing. As the stop block is lifted, the spring 360 will be wound or re-loaded and as the upper pin 590 of the stop block passes the crooked portion 594 in the slot, the block will snap into its operating position. The load of spring 360 will maintain the stop block in its upper position (shown), since the stop block can move downward only by overcoming the load of spring 360.

Thus, it has been shown that the apparatus, side pocket mandrel 30, electrical connector 44 and 140, the kickover tool 300, and the running tool 346 fulfill the objects of the invention which were set out early in this application.

The foregoing description and drawings of the invention are explanatory only and various cnanges in sizes, shapes, materials, and arrangements of parts, as well as certain details of construction, may be made within the scope of the appended claims without departing from the true spirit of the invention.

I claim:

1. A side pocket mandrel for receiving an electrically powered instrument for monitoring a parameter, such as pressure, temperature, or the like, at a subsurface location in a well, comprising:

a. an elongate body having connection means at its upper and lower ends for attachment in a string of well tubing and having a flow passage therethrough alignable with the bore of the tubing;

b. a receptacle bore in said body laterally offset from and extending alongside said flow passage, the lower end of said receptacle bore opening to the exterior of said body;

c. an internal longitudinal keyway-like channel in the wall of said flow passage aligned with and extending upwardly from the upper end of said receptacle bore to a location near the connection means at the upper end of said body, the inward side of said channel being open to said flow passage, the upper end of said receptacle bore being accessible through said channel by tools lowered through said well tubing into the flow passage of said body; and d. an electrical contact assembly sealingly engaged in and closing the lower end of said receptable bore and having an insulated conductor rod extending therethrough, the lower end of said insulated conductor rod being connectable to electrical conduction means extending to the surface, and the upper end of said conductor rod extending into said receptacle bore providing an electrical contact engageable by an electrical contact of an instrument lowered through the well tubing and installed in said body with its lower end received in said receptacle bore and its major portion housed in said channel above said receptacle bore, leaving said flow passage unobstructed.

2. The side pocket mandrel of claim 1, wherein said receptacle bore is provided with a drain port opening into said main bore adjacent the location where said electrical contact assembly closes the lower end of said receptacle bore, said receptacle bore being otherwise imperforate intermediate its ends.

3. The side pocket mandrel of claim 2, including: orienting means in said body above the upper end of said channel for orienting a kickover tool relative to said channel and said receptacle bore.

4. The side pocket mandrel of claim 1, wherein said receptacle bore is parallel to said main bore of said elongate body.

5. The side pocket mandrel of claim 4, including: orienting means in said body above the upper end of said channel for orienting a kickover tool relative to said channel and said receptacle bore.

6. The side pocket mandrel of claim 1, including: orienting means in said body above the upper end of said channel for orienting a kickover tool relative to said channel and said receptacle bore.

7. A side pocket mandrel for receiving an electrically powered instrument for monitoring a parameter such as pressure, temperature, or the like, at a downhole location in a well, comprising:

a. an elongate body having a main bore therethrough and means at its opposite ends for connection to a string of well tubing;

b. a receptacle bore in said body laterally offset from and extending alongside said main bore, the lower end of said receptacle bore opening to the exterior of said body, said receptacle bore having an internal annular recess intermediate its ends;

c. an internal longitudinal keyway-like channel in the wall of said main bore aligned with and extending upwardly from the upper end of said receptacle bore to a location near the upper end of said side pocket mandrel, the inward side of said channel being open to said main bore, the upper end of said receptacle bore being accessible through said channel by tools lowered into said side pocket mandrel through the well tubing; and d. an electrical contact assembly secured in the lower end of said receptacle bore, said electrical contact assembly comprising:

i. a plug member having means on one of its ends for sealed connection with the lower end of said receptacle bore, said plug member having a bore therethrough, ii. conductor rod means disposed in said bore of said plug member and having its external end connectable with a conductor extending to the surface, the internal end of said conductor rod terminating in an upstanding contact within said receptacle bore, and iii. means insulating said conductor rod from said plug member, in combination with an instrument for monitoring a parameter in the well, said instrument including:

a. an electrically powered instrument member for monitoring a parameter, such as well pressure, well temperature, or the like, said instrument member having means thereon engageable with said internal annular recess in said receptacle bore; and b. electrical receptacle means on the lower end of said instrument for engaging said upstanding electrical contact in the lower end of said receptacle bore, said electrical receptacle means comprising:

i. a tubular connector housing connectable to the lower end of said instrument member and having an open lower end telescopable over said upstanding electrical contact when said instrument member is installed in said receptacle bore of said side pocket mandrel, ii. a female conductor member in said housing having a lower open end for receiving said upstanding contact to effect an electrical connection, iii. means insulating said female conductor member from said tubular connector housing, iv. means connecting said female conductor member to said electrically powered instrument member, v. a floating plug in said bore of said female conductor initially positioned at the lower open end thereof, and vi. a non-conducting liquid in the bore of said female conductor member above said floating plug, c. whereby when said instrument is installed in said receptacle bore, said upstanding contact upon entering said bore of said female conductor will force said non-conducting liquid to flow downward around said floating plug and said upstanding contact and will flush away any well fluids and debris from the conductor members being mated to assure good electrical contact therebetween.

8. The combination of claim 7, including: orienting means in said body above the upper end of said channel for orienting a kickover tool relative to said channel and said receptacle bore.

9. Tne combination of claim 8, including:

a. means in said tubular connector body and means on said floating plug coengageable to limit downward movement of said floating plug relative to said body; and b. means sealing between said tubular connector body and said floating plug to prevent loss of said non-conducting liquid and for sealing between said tubular connector body and said upstanding contact when said instrument is fully inserted in said receptacle bore of said side pocket mandrel.

10. The combination of claim 9, wherein said tubular connector body is formed with a fluid passage connecting the upper portion of said bore of said female conductor with the exterior of said tubular connector body, and a check valve is provided in said fluid passage to prevent escape of said non-conducting liquid from said bore of said female conductor but allowing the flow of fluids from the exterior of said tubular connector body into said bore of said female conductor member during disengagement of said instrument member from said upstanding contact in said receptacle bore.

* * * * *